US005105602A

United States Patent [19]

Ono

[11] Patent Number: 5,105,602

[45] Date of Patent: Apr. 21, 1992

[54] AUTOMATIC WRAPPING METHOD OF CYLINDRICAL ARTICLES, PARTICULARLY PLASTIC BOBBINS AND APPARATUS THEREFOR

[75] Inventor: Nobutaka Ono, Ashiya, Japan

[73] Assignee: Osaka Bobbin Kabushiki Kaisha, Osaka, Japan

[21] Appl. No.: 641,489

[22] Filed: Jan. 15, 1991

[30] Foreign Application Priority Data

Jan. 18, 1990 [JP] Japan ..... 2-10057

[51] Int. Cl.[5] ..... B65B 19/34

[52] U.S. Cl. ..... 53/443; 53/148; 53/245; 53/444; 53/466; 53/536

[58] Field of Search ..... 53/148, 150, 245, 442, 53/443, 444, 452, 463, 466, 479, 535, 536, 537, 540, 554, 555, 557, 558

[56] References Cited

U.S. PATENT DOCUMENTS

| | | | |
|---|---|---|---|
| 2,825,193 | 5/1958 | Loveridge | 53/536 |
| 2,856,740 | 10/1958 | Repass | 53/536 X |
| 3,089,297 | 5/1963 | Craig et al. | 53/444 |
| 3,295,290 | 1/1967 | Billingsley et al. | 53/557 X |
| 3,823,528 | 7/1974 | Janssen | 53/557 X |
| 3,864,893 | 2/1975 | Murao | 53/536 X |
| 3,903,673 | 9/1975 | Grasvoll | 53/535 |
| 3,959,951 | 6/1976 | Paules | 53/535 X |
| 3,994,114 | 11/1976 | Nishimura | 53/463 X |
| 4,104,846 | 8/1978 | Waller | 53/443 |

FOREIGN PATENT DOCUMENTS

| | | | |
|---|---|---|---|
| 602415 | 4/1978 | U.S.S.R. | 53/245 |

*Primary Examiner*—Robert L. Spruill
*Assistant Examiner*—Daniel B. Moon
*Attorney, Agent, or Firm*—Flynn, Thiel, Boutell & Tanis

[57] ABSTRACT

An automatic wrapping apparatus of cylindrical articles, particularly plastic bobbins. The apparatus includes feed rollers for feeding two wrapping sheets therebetween in opposed manner to form a bottom portion for a wrapping bag. A loading device is provided for loading bobbins onto the bottom portion by holding each unit of regularly arranged bobbins and dropping it in an orderly state. A support member is provided for supporting the bobbins unit by unit from underneath and causing the bobbin unit whenever dropped to descend by the bobbin height, thus stacking bobbin units one upon another. A basket-like retainer is provided for receiving the bobbin units descending with stacking to retain them in the place so as to keep the orderly state. A heat sealer is provided for uniting the bottom portion and a top margin of the wrapping bag. A side heat sealer is provided for uniting both sides of the bag. A method of packaging the bobbins includes the steps of feeding two wrapping sheets to form by heat sealing a bottom portion of a wrapping bag. Each unit of bobins regularly arranged in a holder is then loaded onto the bottom portion by dropping from the holder, simultaneously causing each dropped bobbin unit to descend by the bobbin height while supporting bobbins from below and retaining from the perimeter, and stacking bobbin units one upon another in the sheets. Thereafter, the top and both side margins of the bag are heat sealed.

5 Claims, 3 Drawing Sheets

AUTOMATIC WRAPPING METHOD OF CYLINDRICAL ARTICLES, PARTICULARLY PLASTIC BOBBINS AND APPARATUS THEREFOR

FIELD OF THE INVENTION

This invention relates to a method of automatically wrapping cylindrical, lightweight articles that are prone to roll such as platic bobbins in quantity by arranging them in an orderly fashion, and an apparatus therefor.

BACKGROUND OF THE INVENTION

In various yarn treatments such as dyeing, generally, yarn packages wound around bobbins are axially compressed and subjected to a treatment. Tremendous quantities of bobbins are necessary for any yarn treatment, and consequently, it is indispensable to furnish bobbins at a low cost. To that end, not only automation of the production per se of bobbin articles, but also automation of packing of them are required.

Sealed packing of lightweight articles has heretofore been carried out, according to which articles are placed in a shrinkable bag and its mouth is sealed, or articles are inserted between two sheets horizontally tensioned and the whole marginal portions are sealed.

If the aforesaid packing method is applied to wrapping of a plurality of cylindrical, lightweight artilces, particularly bobbins, the bobbins will be packed in haphazard, irregular state and the resulting package will be bulky and assume an irregular configuration, which poses problems of transportation and storage.

The problems could be solved by such a method of approach that bobbins are adjacently juxtaposed and oriented in alignment, stacked one upon another in regular fashion, and wrapped in that orderly state. However, a problem with bobbins upon wrapping is that because of their cylindrical shape and light weight, they are liable to roll and cannot maintain the orderly orientation. Hence, such an orderly wrapping method and apparatus for bobbins has never been provided and actually is not existing.

In order to cope with the present situation, this invention has been accomplished by contriving a new mechanism for securely supporting bobbins enveloped within wrapping sheets.

Accordingly, this invention is designed for providing an automatic wrapping method of bobbins which is capable of wrapping a plurality of bobbins in an orderly stacked state, and an apparatus therefor.

SUMMARY OF THE INVENTION

According to one aspect of this invention, an automatic wrapping method of cylindrical articles, particularly plastic bobbins comprises the sequential steps of: unwinding two wrapping sheets from two web sheet rolls over two turn rollers which are disposed substantially horizontally and in parallel with each other so as to be spaced apart a distance wider than the axial length of cylindrical bobbins into an opening zone between the turn rollers; uniting the leading ends of the wrapping sheets so reeled out with each other to form bottom sheet portions for a package bag to be later completed; dropping, at the opening zone, every unit of a given number of bobbins adjacently juxtaposed and oriented in alignment onto the bottom sheet portions in turn in such a manner that the orientation direction of the bobbins and the axial direction of the turn rollers are in agreement with each other; stacking units of the bobbins one upon another while supporting every unit of bobbins dropped on the bottom sheet portions from beneath them and, whenever a unit of bobbins is dropped, simultaneously causing the stacked bobbins with the sheets therearound to descend by the height of bobbins; receiving the bobbins descending with the stacking in a case until one pack of a definite unit number of bobbins have been stacked on the bottom sheet portions and received wholly in the case; uniting two upper sealing areas of the sheets located directly above the stacked bobbins with each other and simultaneously severing between the two areas to separate the resulting package bag from the web sheets; and uniting the bag at both lateral sheet edge portions which project beyond lateral sides of the stacked bobbins, with the stacked bobbins held in the case, whereby a package of bobbins is obtained.

According to a preferred embodiment of the wrapping method, a heat-shrinkabie sheet is used as a wrapping sheet and after uniting of the upper parts and both lateral edge portions of the wrapping sheets, the resulting package of bobbins retained in the case may be placed in an air-heating furnace to subject the sheets to shrinkage processing.

According to another aspect of this invention, there is provided an automatic wrapping apparatus of cylindrical articles, particularly plastic bobbins which comprises: two turn rollers disposed substantially horizontally and in parallel with each other in a spaced relation of a distance wider than the axial length of bobbins, thereby defining an opening zone between them; sheet feed means for feeding two wrapping sheets over the turn rollers into the opening zone in opposing manner; top or bottom uniting means for uniting together leading ends of the sheets thus fed at the opening zone thereby to form bottom sealed sheet portions for a package bag and, after complete wrapping, for uniting together two areas of the sheets located immediately above enclosed bobbins to form top sealed sheet portions of the package bag, the top or bottom uniting means being located below the turn rollers so as to be horizontally movable toward or away from each other; loading means for holding therein every unit of a given number of bobbins adjacently juxtaposed and oriented in alignment and dropping, at the opening zone, the unit of bobbins therefrom onto the bottom sheet portions in turn so that the orientation direction of bobbins and the axial direction of the turn rollers are in agreement with each other; supporting means for suppporting units of bobbins loaded on the bottom sheet portions from beneath them and for causing the bobbins with the sheets enclosing therearound to descend by the height of bobbins whenever every unit of bobbins is transferred onto the bottom sheet portions thereby to stack a definite unit-pack of bobbins one upon another, the supporing means being vertically movable; a case for receiving therein the stacked bobbins surrounded by the sheets descending with the stacking of every unit of bobbins, the case being located below the opening zone; cutting means for cutting the sheets at the united parts to separate them from the top-sealed package bag, the cutting means being disposed below the top or bottom uniting means; and lateral uniting means for uniting together both lateral sheet edge portions of the package bag so separated housing therein one pack of bobbins, thus producing a package of bobbins.

According to the method and apparatus of this invention, at the outset, two wrapping sheets are unwound upwardly through the sheet feed means over the turn rollers into the opening zone and concurrently, leading ends of the sheets are united together to form bottom sheet portions for a package bag.

Every unit of a given number of bobbins which are adjacently juxtaposed and oriented in alignment is held in a holder and then dropped at the opening zone from the holder onto the bottom sheet portions in a horizontal state so that the orientation direction of the bobbins in the holder and the axial direction of the turn rollers are in agreement with each other.

The bobbins dropped unit by unit are supported from below the bottom sheet portions, and the supporting means descends by the height of bobbins whenever every unit of bobbins is dropped. Units of bobbins are dropped at the opening zone in turn and thus stacked one upon another, and in conformity with the stacking, the supporting means also descends. As a consequence, each unit of bobbins is dropped always onto the same location of a constant height, and orderly stacking is possible without breaking the orientation of bobbins.

The units of bobbins and sheets therearound descending with the stacking are received in the case and prevented from rolling, and consequently, the orderly stacking conditions is maintained. At this time, the web sheets are unwound via the sheet feed means with the descending of bobbins and enclose the stacked bobbins at their both circular marginal ends on the front and rear sides of the apparatus.

When a definite unit number of bobbins per one pack is reached on the bottom sheet portions, the sheets enclosing therein the stacked bobbins are bonded together at upper portions thereof located immediately above the bobbins and at both lateral edge portions thereof with the package of bobbins received in the case. In bonding the upper sheet portions, two adjacent areas there having a slight interspace therebetween are bonded and sealed respectively, and the intermediate between the two areas is severed. Thus the package bag of bobbins sealed at whole margins thereof is separated from the upstream web sheets fed by the sheet feed means while the upstream web sheets sealed at the bottom sheet portions are supplied to the opening zone to provide a new package bag for receiving therein another pack of bobbins. And a new cycle of the foregoing steps will be repeated again. In this way, a definite unit number of bobbins can be wrapped in orderly stacked state to yield a package of bobbins.

DESCRIPTION OF PREFERRED EMBODIMENTS

Examples of the automatic wrapping apparatus and method according to this invention will be hereinafter described with reference to the accompanying drawings.

Figure 1:
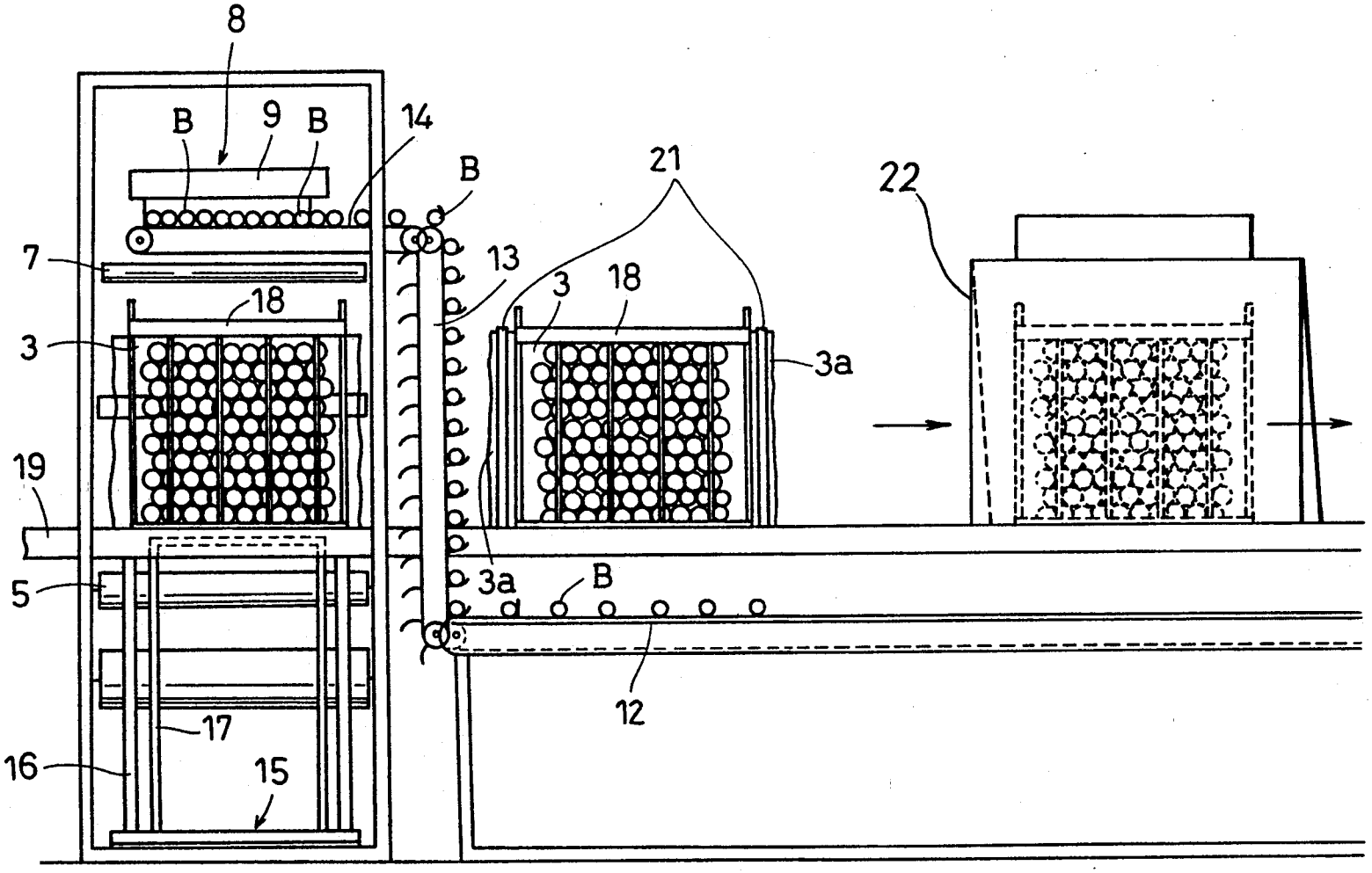
FIG. 1 is a schematic front elevational view of one example of a wrapping apparatus according to this invention.
Figure 2:
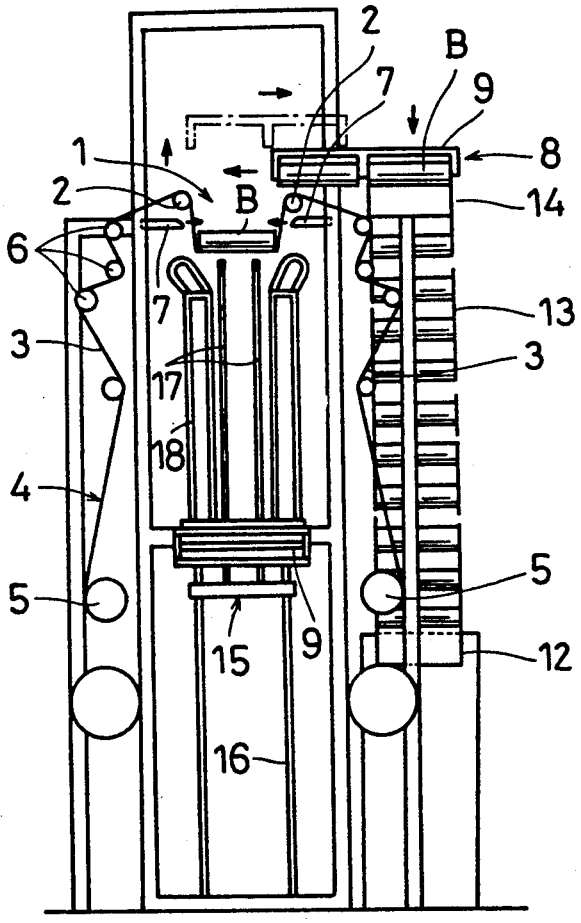
FIG. 2 is a right elevational view of the apparatus in FIG. 1 with its right half omitted.
Figure 3:
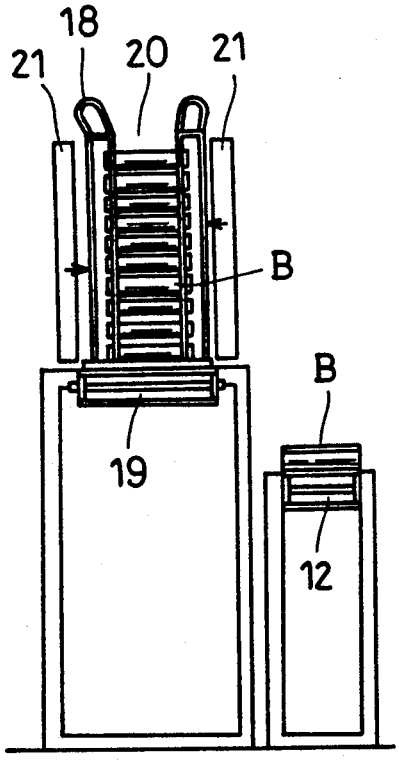
FIG. 3 is a right elevational view of the apparatus in FIG. 1 with its left half omitted.

FIGS. 1 to 3 show one example of an automatic wrapping apparatus for bobbins.

Referring to FIG. 2, two sheet feed means 4 comprise each a web sheet roll 5 and a tensioning device 6 for imparting tension upon a wrapping sheet 3 unwound from the web roll 5.

Two wrapping sheets 3 unwound through the sheet feed means 4 are fed upwardly over two turn rollers 2 into an opening zone 1 defined between the turn rollers 2. The two turn rollers 2 are opposed horizontally and in parallel with each other in a spaced relation of a distance wider than the axial length of cylindrical bobbins B, thus defining the opening zone 1. In this example, a heat-shrinkable sheet, e.g. polyvinyl chloride sheet is used as a wrapping sheet 3.

Below the turn rollers 2, a pair of welding trowels 7 serving as uniting means are provided to be horizontally slidable so as to make contact with each other. The welding trowels 7 move toward each other when the two sheets 3 are unwound to the opening zone 1, and make contact with each other, inserting the leading ends of the sheets 3 therebetween and concurrently, bond the leading ends together by hot melting. Thereafter the welding trowels 7 move away from each other and revert to the original locations. The uniting of the sheets is conducted by hot melting by means of the welding trowels in this embodiment, but other uniting means such as an adhesive applicator may also be used.

The foregoing welding trowels 7 are actuated, also when one pack of bobbins is wrapped up, to unite the sheets together at upper portions thereof immediately above the stacked bobbins.

Below the welding trowels 7, there is provided a cutter (not shown) for cutting the intermediate between two adjacent sealed areas of the upper sheet portions above the bobbins, to separate the package bag from the web sheets and simultaneously to newly supply wrapping sheets 3 for a new package bag continuing from the web rolls 5.

Figure 4:
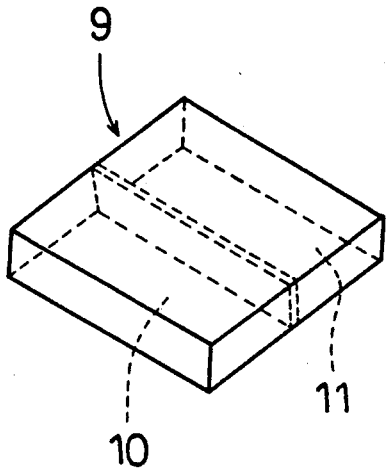
FIG. 4 is a perspective view showing a holding member.

In FIGS. 1 and 2, loading means 8 of bobbins B is illustrated. The loading means 8 comprises a box-shaped holding member 9 with the lower side opened, as clearly seen from FIG. 4 and a drive means (not shown). The holding member 9 has holding rooms 10, 11 each holding therein a given number of bobbins constituting one unit on the front and rear sides, and is adapted to be capapble of advancing, ascending, retreating and descending by means of air cylinder, etc.

Bobbins B to be wrapped are supplied from the manufacturing stage through a lower conveyor 12 and a vertical conveyor 13 to an upper conveyor 14, on which the bobbins are oriented in alignment and adjacently juxtaposed so that the orientation direction is in agreement with the axial direction of the turn rollers 2. The upper conveyor 14 is provided with a stopper (not shown) at a terminal end thereof, and bobbins conveyed are stopped there and the adjacent juxtaposition state is maintained.

Figure 5A:
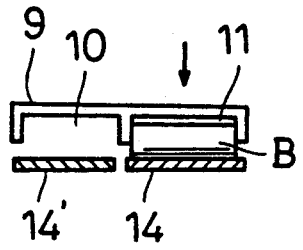
FIG. 5*a* to FIG. 5*d* are illustrative representations showing the action of the holding member.
Figure 5B:
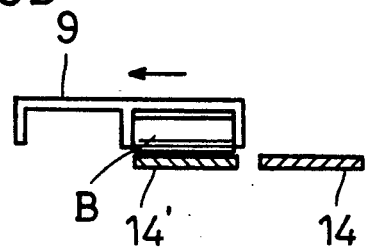
Figure 5C:
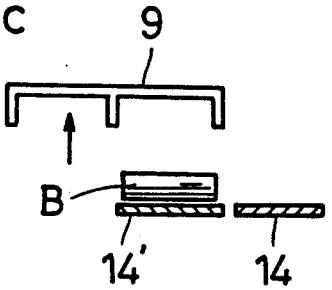
Figure 5D:
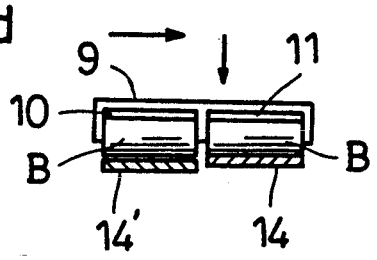

Then the holding member 9 descends to hold a unit of bobbins B on the upper conveyor in the rear holding room 11 (FIG. 5*a*), advances to displace the unit of bobbins B onto a stand 14' which is attached to the machine frame adjacent to the conveyor 14 (FIG. 5*b*), ascends in that position (the holding member 9 is empty) (FIG. 5*c*), and retreats and descends to hold the previous unit of bobbins B and a new unit of bobbins B supplied on the conveyor 14 in the front and rear rooms 10, 11 respectively (FIG. 5*d*). In that state, when the holding member 9 again advances, the previous unit of bobbins in the front room 10 is dropped onto the bottom sheet portions at the opening zone 1 (FIG. 2). This cycle of actions is repeated, whereby the loading of every unit of bobbins into the wrapping sheets is performed.

The refererence numeral 15 designates a bobbin stand (support) as a supporting means. The bobbin stand 15 is mounted to be slidably movable up and down with the aid of a gear, air cylinder, etc., while being guided by a guide 16, and has two frames 17 provided vertically thereon. The upright frames 17 serve to support bobbins B which are dropped onto the bottom sheet portions at the opening zone 1, from underside.

The bobbin stand 15 descends by the height of bobbins whenever every unit of bobbins B is dropped at the opening zone 1 and causes the stacked bobbins B with the sheets 3 therearound to descend, accordingly. Whenever the loading means 8 drops each unit of bobbins onto the bottom sheet portions in turn, the previous unit of bobbins dropped descends responsively, so that whole units of bobbins can be stacked neatly one upon another.

Where the bobbins are too lightweight to stand the tension of the web sheets and are difficult to descend, any presser means above the bobbins may be disposed, in addition to the bobbin stand.

The reference numeral 18 designates a case, which is transferred by a case conveyor 19.

The case 18 in empty state travelled by the conveyor 19 is located below the opening zone 1, where it receives therein the bobbins B and the sheets 3 descending with the stacking as described above.

The case 18 is formed to splay, having vertical props spaced at intervals, and its both lateral sides are defined with vertical gaps 20, through which both lateral edge portions 3*a* of the sheets 3 enclosing therein one-pack units of bobbins B are protruded out.

The case 18 and the bobbin support 15 are associated in a manner that the frames 17 of the bobbin support 15 are entered into a bottom wall of the case 18 and a belt of the conveyor 19 through slits defined in both.

The reference numeral 21 designates a pair of side welding trowels for uniting together each lateral edge portions of the sheets wrapping up therein one pack of definite units of bobbins. The side welding trowels 21 assume a vertically elongated form. Two pairs of side welding trowels 21 are spaced apart a distance greater than the breadth of the case 18 and disposed on the conveyor 19 outside the loading station where bobbins are loaded from the loading means 8 in the illustrated embodiment (FIG. 1). Alternatively, two pairs of the side welding trowels 21 may be located below the opening zone 1.

Two pairs of the welding trowels 21 are horizontally movable by means of an air cylinder, etc. (not shown) and serve to melt-bond the lateral edge portions 3*a* of the sheets 3 by pinching them between the welding trowels.

OPERATION

One example of operation of the automatic wrapping apparatus as described above will be explained below.

First, the conveyor 19 transfers the case 18 in empty state to a location just below the opening zone 1 and stops by the action of a limit switch. Simultaneously the bobbin stand 15 ascends up to its uppermost position.

On the other hand, at the opening zone 1, two wrapping sheets 3 are unwound upwardly from the sheet feed means 4 over the turn rollers 2, from where leading ends of them are directed downwardly and united together by means of the welding trowels 7 to form a bottom part for a wrapping bag to be completed later.

Onto the bottom sheet portions as the bottom part, every unit of a given number of bobbins B adjacently juxtaposed is dropped in turn by means of the loading means 8.

Every time each unit of bobbins B is dropped, the bobbin stand 15 descends by the height of bobbins, and consequently, units of bobbins are stacked one upon another neatly. The bobbins B descending by stacking are received in the case 18. At this time, the sheets encircle both circular marginal sides of the bobbins (the front and rear sides of the apparatus) as shown in FIG. 1.

When the unit number of bobbins retained in the sheets reaches one pack of units, upper sealing area of the sheets located directly above the stacked bobbins is united together. Another upper sealing area of the sheets located a little above is also united together simultaneously. The intermediate between both united parts of sheets is cut with cutting means located below the welding trowels 7, and the wrapping bag of bobbins is separated out from the web sheets 3 continuing from the web rolls 5. The other united part thus separated and continuing from the web sheets 3 forms a bottom part of a new wrapping bag for packing therein next bobbins.

The wrapped bobbin package now sealed at top and bottom sides thereof is transferred by the case conveyor 19 to the lateral sealing station (at the right in FIG. 1) and stops between two pairs of the side welding trowels 21. Both side edge portions 3*a* of the sheets 3 protruding through the vertically elongated gaps 20 are united together by means of the side welding trowels 21 (Cf. FIG. 1, 3).

Lastly, the case 18 carrying therein one pack of bobbins is transferred by the case conveyor 19 to an air-heating furnace 22, where the wrapping sheets of the package are heat-shrunk. Thus a package of bobbins is yielded, wherein a definite unit number of bobbins are stacked one upon another in orderly state and the wrapped sheets are secured on the bobbins.

The above cycle of operation is automatically, continuously repeated, and wrapping to bobbin packages is performed.

The foregoing example is concerned with wrapping of plastic bobbins, but this invention can also be applied to wrapping of other lightweight cylindrical articles that are liable to roll.

It will be appreciated that the construction of the apparatus of this invention can be varied and modified without departing from the object and spirit of the invention.

According to the automatic wrapping method of plastic bobbins, etc. and apparatus therefor of this invention, wrapping is conducted by stacking units of bobbins adjacently juxtaposed and aligned one upon another, concurrently with which the bobbins being wrapped are supported from the surroundings and downside. As a consequence, bobbins are prevented from rolling and it is possible to stack and wrap a predetermined unit number of bobbins stably and regularly. Sealing of the wrapping sheets is conducted with the bobbins received in the case, and consequently, a pack of bobbins can be wrapped, while retaining the same configuration without disorder. Bobbin packages thus wrapped regularly and in a definite configuration facilitate transportation and storage of them, and assist in mass production of bobbins.

What is claimed is:

1. A method of wrapping automatically cylindrical articles, comprising a cycle of the sequential steps of:

unwinding two wrapping sheets from respective web sheet rolls and guiding the sheets over two turn rollers opposed horizontally and spaced apart a distance wider than an axial length of the cylindrical articles into an opening zone between the turn rollers;

heat-sealing leading ends of the sheets thus unwound to form a bottom portion of a wrapping bag to be subsequently completed;

holding each unit consisting of a finite number of cylindrical articles adjacently juxtaposed and aligned regularly in a holder to transfer the holder to the opening zone and dropping, at the opening zone, said unit of cylindrical articles from the holder onto the bottom portion in such a manner that the juxtaposing direction of the unit of cylindrical articles is in the same direction as the axial direction of the turn rollers, thus loading each cylindrical article unit onto the sheets;

stacking cylindrical article units one upon another while supporting the cylindrical article units dropped unit by unit on the bottom portion from beneath them and causing the cylindrical article units and sheets therearound to descend by a top to bottom dimension of each cylindrical article unit whenever every unit of cylindrical articles is dropped;

receiving stacked cylindrical article units supported from below and descending with the stacking thereof in a receptacle so as to retain them in place;

after one pack of a finite unit number of cylindrical articles has been stacked, heat-sealing upper portions of the sheets located immediately above the stacked cylindrical articles and separating the resulting top sealed wrapping sheets from the web sheets; and heat-sealing both lateral edge portions of the wrapping sheets enclosing therein the stacked cylindrical article units received in the receptacle, thus completing the wrapping bag, whereby a package of cylindrical articles in a receptacle is yielded.

2. The automatic wrapping method as set forth in claim 1, wherein each cycle of the steps is continued by heat-sealing two upper adjacent portions of the sheets and separating the top sealed wrapping sheets from the web sheets defining the next bottom portion for a new wrapping bag, with which a next cycle of the steps is repeated.

3. The automatic wrapping method as set forth in claim 1, wherein the wrapping sheet is a heat-shrinkable sheet and after the heat-sealing of the lateral edge portions step, the resulting package of cylindrical articles retained in the receptacle is placed in an air-heating furnace so as to subject the sheets to shrinkage processing.

4. An automatic wrapping apparatus for cylindrical articles, comprising:

two turn rollers opposed substantially horizontally and spaced apart a distance wider than the axial length of the cylindrical articles, thus defining an opening zone between them;

sheet feed means for feeding upwardly two wrapping sheets over the turn rollers into the opening zone in an opposed manner;

heat-sealing means for uniting together leading ends of the two sheets thus fed to form a bottom portion for a wrapping bag and for uniting together upper sheet portions, after wrapping of cylindrical articles, located immediately above the cylindrical articles to form a top margin for wrapping bag, said heat-sealing means being disposed below the turn rollers so as to be horizontally movable toward or away from each other;

loading means for holding therein each unit consisting of a finite number of cylindrical articles adjacently juxtaposed and aligned regularly to drop, at the opening zone, said unit of cylindrical articles therefrom onto the bottom portion in turn in a manner that the alignment direction of the cylindrical article unit is in the same direction as the axial direction of the turn rollers, the loading means including a box-shaped holding member which is vertically and horizontally movable between the opening zone and sheet feeding zone and open at its lower side;

supporting means for simultaneously supporting cylindrical articles being dropped unit by unit on the bottom portion from beneath and for causing the cylindrical article units and sheets therearound to descend by a top to bottom dimension of each of the cylindrical articles whenever every unit of cylindrical articles is dropped onto the bottom portion, thus stacking units of cylindrical articles one upon another;

a retainer for receiving therein cylindrical articles descending with the stacking so as to retain them in place, the retainer being located below the opening zone and above the supporting means; and side heat-sealing means for uniting the sheets wrapping therein one pack of stacked cylindrical articles at both lateral edge portions thereof, said supporting means including a guide member and a stand having vertically upright frames thereon, the upright frames being adapted to extend through the retainer, the stand being vertically movable on the guide member from a position spaced below the retainer up to the position of the retainer, said upright frames extending through the retainer.

5. The automatic wrapping apparatus as set forth in claim 4, further comprising an air-heating furnace for subjecting the sheets to heat-shrinkage, thereby to secure the wrapped sheets on the cylindrical articles, the wrapping sheets being a heat-shrinkable sheet.

* * * * *